US007563105B2

(12) United States Patent
Liu et al.

(10) Patent No.: US 7,563,105 B2
(45) Date of Patent: Jul. 21, 2009

(54) ELECTRICAL CONTACT HAVING ASYMMETRIC DUAL-CONTACT-ENGAGING-ARM

(75) Inventors: Jia-Hau Liu, Tu-cheng (TW); Fu-Pin Hsieh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,973

(22) Filed: Aug. 18, 2008

(65) Prior Publication Data

US 2009/0047817 A1 Feb. 19, 2009

(30) Foreign Application Priority Data

Aug. 17, 2007 (CN) ..... 2007 2 0042935 U

(51) Int. Cl.
*H01R 12/00* (2006.01)

(52) U.S. Cl. ..... 439/66; 439/862

(58) Field of Classification Search ..... 439/66, 439/862, 71, 73

See application file for complete search history.

(56) References Cited

U.S. PATENT DOCUMENTS 5,722,848 A 3/1998 Lai et al.
6,371,784 B1 4/2002 Scholz et al.
6,540,526 B2 * 4/2003 Toda ..... 439/66
6,694,609 B2 2/2004 Lopata et al.
6,887,114 B2 5/2005 Liao
6,905,377 B2 6/2005 Murr
6,908,313 B2 6/2005 Walkup et al.
7,001,197 B2 2/2006 Shirai et al.
7,156,706 B2 * 1/2007 Brown et al. ..... 439/862
7,357,665 B1 * 4/2008 Yan ..... 439/500
7,390,195 B2 * 6/2008 Liao ..... 439/66
7,427,203 B2 * 9/2008 Liao ..... 439/66
7,435,100 B2 * 10/2008 Chang et al. ..... 439/66
2005/0020146 A1 * 1/2005 McAlonis et al. ..... 439/862
2005/0054218 A1 * 3/2005 Liao et al. ..... 439/66

* cited by examiner

*Primary Examiner*—Gary F. Paumen
(74) *Attorney, Agent, or Firm*—Wei Te Chung

(57) ABSTRACT

A contact (1) is provided for use in a land grid array (LGA) socket (300). The contact (1) of the present invention comprises a support body (12), a first contact arm (13) and a second contact arm (14) respectively extend from the same lengthwise side of the supporting body (12) through a first curved arm (131) and a second curved arm (141), a plurality of barb (111) configured in the support body (12) are adapted to securely hold the contact (1) in a hole (202) of a insulative housing. The two contact arms (13), (14) with different length are parallel one another and not aligned in the same plane for preventing contacts from undesired short caused by touching of adjoining contacts while an integrated circuit is mounted in the socket.

9 Claims, 13 Drawing Sheets

ELECTRICAL CONTACT HAVING ASYMMETRIC DUAL-CONTACT-ENGAGING-ARM

BACKGROUND OF THE INVENTION

1. Field of the Invention

The present invention generally relates to an electrical connector, and more particularly to a socket connector having a plurality of contact terminals, each of the contact terminals includes a pair of contact arms both adapted for reliably ensuring electrical connection between a circuit board and a corresponding conductive pad of a processor.

2. Description of Related Art

As the rapid development of electronic technology, the speeds of computers are becoming faster and faster for complying with the public's requests on processing and transfer of huge amount of data, such as image data or three dimensional data. A heart of a computer is a computer processor. The processor is always in a constant state of technical innovation. As the speed of the processor increases, it becomes increasingly important for all the components in the data processing path to become faster in order to prevent data congestion or "bottlenecks." This includes the interface that connects a processor to a printed circuit board (sometimes referred to as a "mother board").

One example of such an interface is referred to as a Pin Grid Array (PGA) socket. The PGA socket is designed to receive a pin grid array of a processor and to establish an electrical connection between the processor and the printed circuit board. The PGA socket varies in types in accordance with such design factors as the number of pins in the pin grid array, the type of contacts located in the PGA sockets, the locking mechanism for maintaining a connection between the contacts and the pins of the pin grid array, and so forth.

Both of U.S. Pat. No. 5,722,848 issued to Lai on Mar. 3, 1998 and U.S. Pat. No. 6,371,784 issue to Scholz on Apr. 16, 2002 disclose a Zero Insertion Force (ZIF) PGA socket. A ZIF PGA socket is a PGA socket that requires little or no force to insert the pins of the pin grid array into the corresponding PGA sockets used for receiving a PGA processor. Refer to FIG. 5, A ZIF PGA socket 10 includes a base 20 having a plurality of passageways 22 extending vertically therethrough for receiving a corresponding number of contacts 24 therein, and a cover 26 having a corresponding number of holes 28 extending therethrough in alignment with the corresponding passageways 22 in the base 20 for allowing a corresponding number of pins extending from the PGA component. A lever 44 includes a cam shaft 48 embedded within a channel 50 formed adjacent the rear region of the socket 10 wherein cover 26 includes a retention device 54 and the base includes a restriction plane 64 to cooperate with the retention device 54 of the cover 26, and both of the retention device 54 and the restriction plane 64 are disposed adjacent the cam shaft 48 for efficiently fastening the cover 26 and the base 20 together to resist the larger resistance force occurring thereabout during the socket 10 in a closed state.

The base 20 showed in FIG. 6~9 includes a plurality of passageways 22 in which a plurality of corresponding contacts 24 are contained. The bottom of contact 24 has a solder recess for receiving a solder ball 208 adapted for mating on a circuit board in subsequent soldering process. When the lever 44 is located in a vertical position, the cover is located at the first position, in which a hole in the cover is completely in align with a corresponding passageway 22 in the base 20. In this position, a pin leg 210 of a CPU can be inserted from the cover 26 into the passageway 22 without any engagement with the contact 24 (Position B in FIG. 9). When the CPU is properly seated on the cover 26, then the lever 44 is moved from the vertical position to a horizontal position, and simultaneously driving the cover 26 from the first position to the second position. After that, the pin leg 210 of the CPU is then in contact with the contact within the base (Position A in FIG. 9).

This PGA base and cover arrangement, however, requires use of a mechanism, such as a lever assembly, thereby introducing excess parts and manufacturing cost. The PGA base and cover arrangement also requires additional space for the contacts as the arms on the contacts must flex outward away from each other to receive the processor pins. These drawbacks are especially troublesome in applications where space is at a premium, such as on motherboards for desktop and laptop computers.

Consequently, Both of U.S. Pat. No. 7,001,197 issued to Shirai on Feb. 21, 2006 and U.S. Pat. No. 6,887,114 issue to Liao on May 3, 2005 disclose another type of socket named as land grid array (LGA) socket which is mounted onto the motherboard by compression-type of contact, or LGA type contact, requiring only vertical compression to allow a processor and a circuit board to electrically communicate. Refer to FIG. 10 and FIG. 11, the LGA socket 300 generally includes a metal stiffener 302 with an insulative housing 304 securely supported therein. It should be recognized that the insulative housing 304 comprising an interior area having a plurality of apertures 312 arranged in a manner of an array in which corresponding contact terminals 314 are constrained. Then a metal clip 306 is pivotally assembled to the stiffener 302. On the other hand, the clip 306 is pivotally assembled to the other side of the stiffener 302 and when the clip 306 is closed to the stiffener 302, a lever 308 having a cam 310 can lock the clip 306 to a closed position. By this arrangement, if before the clip is closed, and a CPU is seated on the housing, then the clip 306 will tightly press the CPU toward the housing 304 ensuring proper electrical connection therebetween.

FIG. 12 discloses a detailed structure of a metal contact 314 for the LGA socket 300. The metal contact 314 is mainly made of a rectangular support body 316, a base portion 318, a contact beam 320 and a solder ball pad 322. The support body 316 further comprises four retention bumps 324 evenly allocated in lengthwise sides of the support body 316. In addition, the supporting body 316 further comprises a curved arm 326 adapted for connecting the support body 316 with the base portion 318. The contact beam 320 with a contact tip 328 is formed with, and extends from, the base portion 318 at a bend 330 at a generally forty-five degree angle to the contact tip 328 for elastically contacting with a bonding pad of a processor. A curved foot 332 extend from the bottom of the supporting body 316 is adapted to connect the solder ball pad 322 for receiving a solder ball. Refer to FIG. 13, the contact beams 320 of the metal contacts 314 in the LGA socket 300 are warped by pads 336 of the CPU 334 to establish electrical connection therebetween as soon as the clip 306 is closed to and locked on the stiffener 302 by the lever 308. However, the contacts in existing LGA socket have only one contact portion to electrically connect with pads of the processor. As a result, there are certain risks of opening in some conducting path between the processor and the socket while the processor is mounted in the LGA Socket. At the same time, a single conducting path would result in high impedance as well against the application of high power connectors.

U.S. Pat. No. 6,694,609 issued to Lapata on Feb. 24, 2004 discloses a LGA contact terminal 400 with two contact arms 420 for solving foregoing problems. However, the contact arms 420 of any LGA contact terminal 400 have a high possibility of getting short by contact arms 420 of the other contact terminal 400 adjacent thereto while contact arms 420 of LGA contact terminals are deflected by pads of CPU. It is also noted that other approaches also use two similar deflectable contact arms respectively extending from two sides of a main body of the contact to result in two contacting points for lowering the impedance. Anyhow, similar to Lapata, because the downwardly deflected contact arm is closer to that of the adjacent contact, there is high possibility to form shorting between the adjacent two contacts while both the deflectable contact arms are downwardly pressed by the CPU. Accordingly, there is a need of providing an improved contact terminal structure adapted for keeping the contact arms with an enough space to prevent all contact terminals from unwilling short.

Hence, it is desired to have an electrical connector with dual contact portion to deal with the problems stated above.

BRIEF SUMMARY OF THE INVENTION

The invention has been developed in view of the circumstance illustrated above. An object of the present invention is for providing a contact terminal with two contact arms for ensuring reliably electrical connection and reducing impedance. Moreover, another object of the present invention is for providing a contact terminal restrained in a socket having two parallel arms with different length and being not aligned in the same plane for preventing contacts from undesired short caused by touching of adjoining contacts while an integrated circuit is mounted in the socket in whole.

The contact terminal of the present invention comprises a support body, a first contact arm and a second contact arm adapted for being warped by pads of an integrated circuit, a first linking arm and a second linking arm adapted for connecting with the support body. Furthermore, there are different projecting heights respectively measured from free ends of the first contact arm and the second contact arm to a plane coplanar with a lower horizontal side of the support body, a plurality of interfering sections configured in lengthwise sides of the support body are adapted for securely holding the contact terminal in a hole of an land grid array (LGA) socket.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
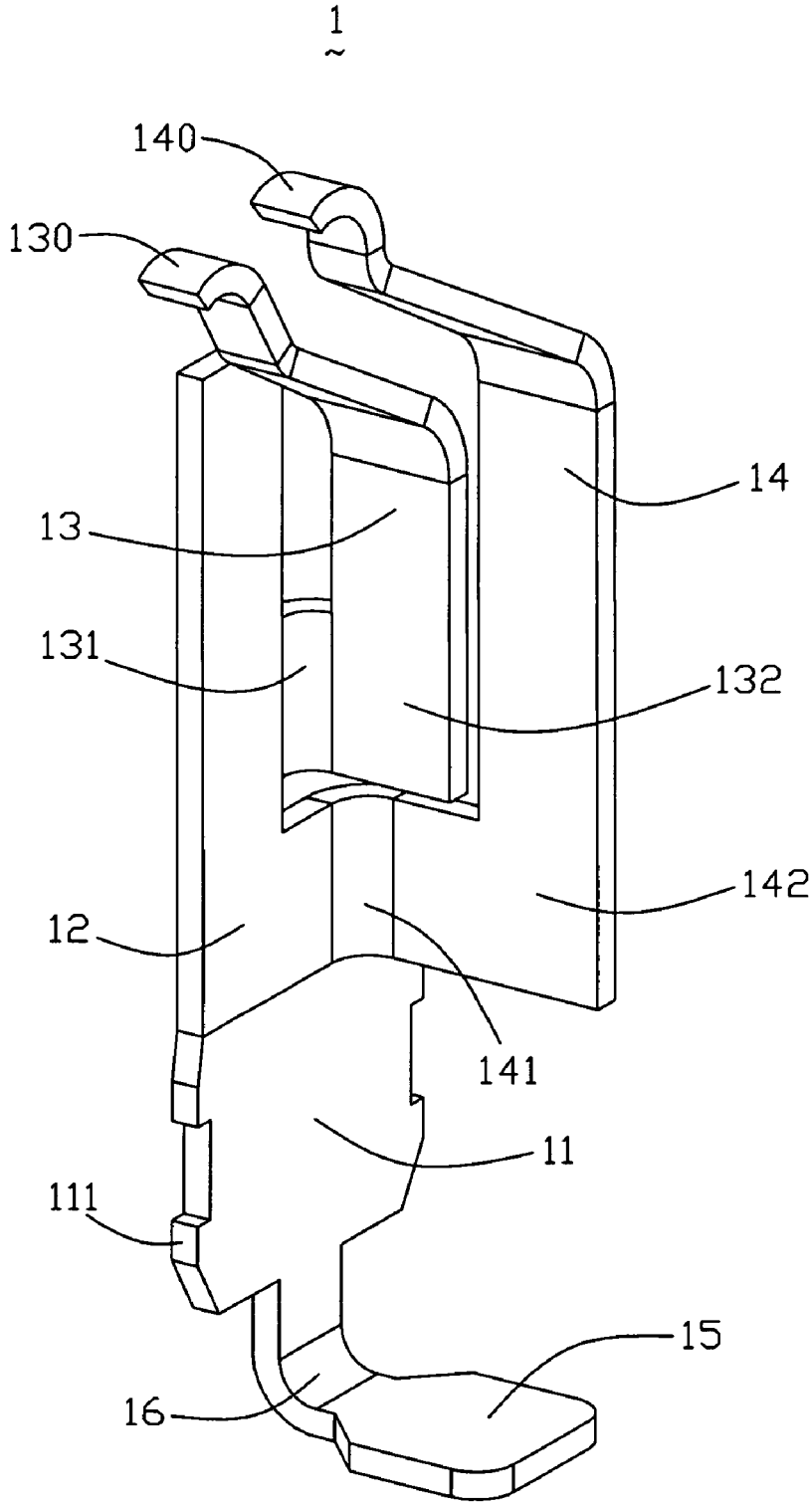
FIG. 1 illustrates an isometric view of a contact with dual arms in accordance with an embodiment of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

FIG. 1 illustrates an isometric view of a land grid array (LGA) contact terminal 1 formed in accordance with one embodiment of the present invention. The LGA contact terminal 1 is made of metal and has a base portion 11 with barbs 111 on two opposite sides to form a retaining portion for holding the LGA contact terminal 1 in a hole of an insulating housing (not shown). An engaging portion 12 upwardly extends from an upper section of the base portion 11. A first contact arm 13 extends upward from a first portion of the engaging portion 12, and a second contact arm 14 extends upward from a second portion of the engaging portion 12. The first contact arm 13 and the second contact arm 14 respectively extend from the same lengthwise side of the engaging portion 12. Beside that, a flat solder portion 15 for receiving a solder ball (not shown) extends from the bottom of the base portion 11 through a curved foot 16.

Figure 2:
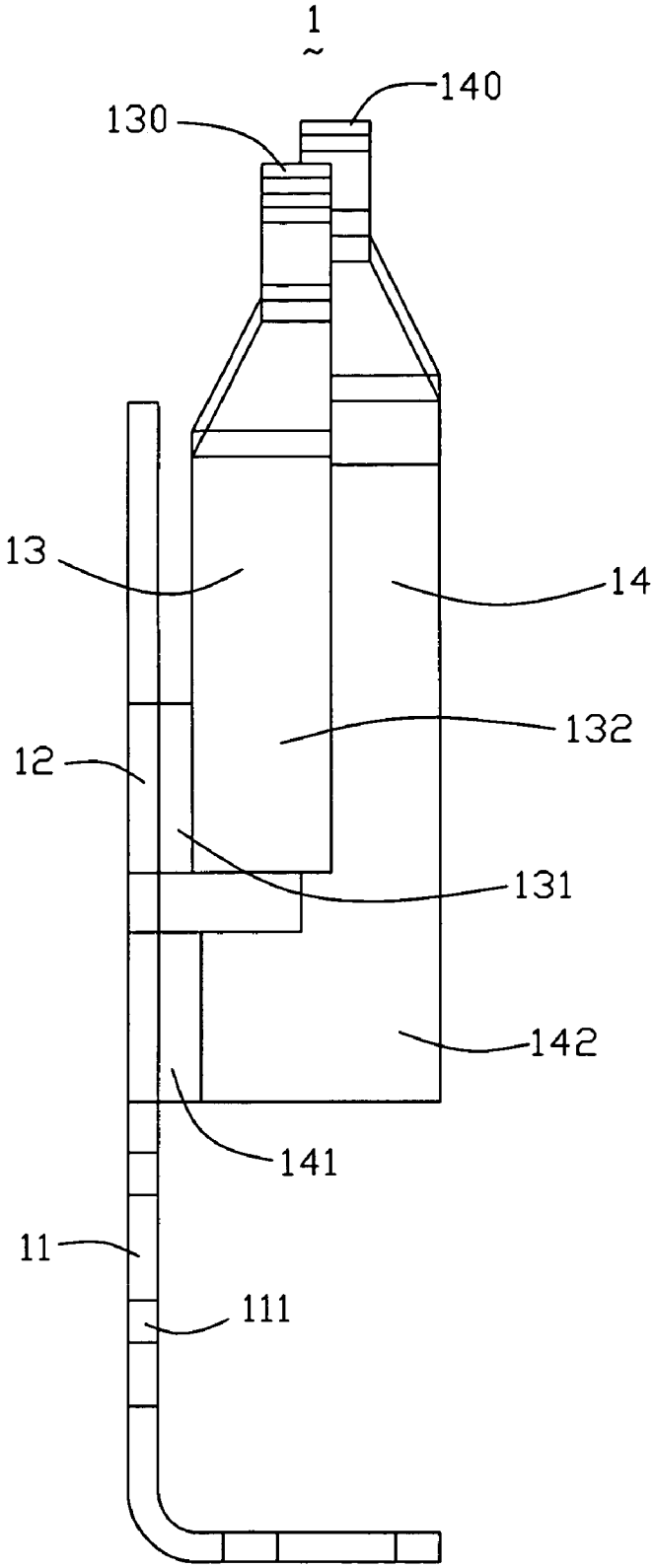
FIG. 2 illustrates a side view of the contact in FIG. 1.
Figure 3:
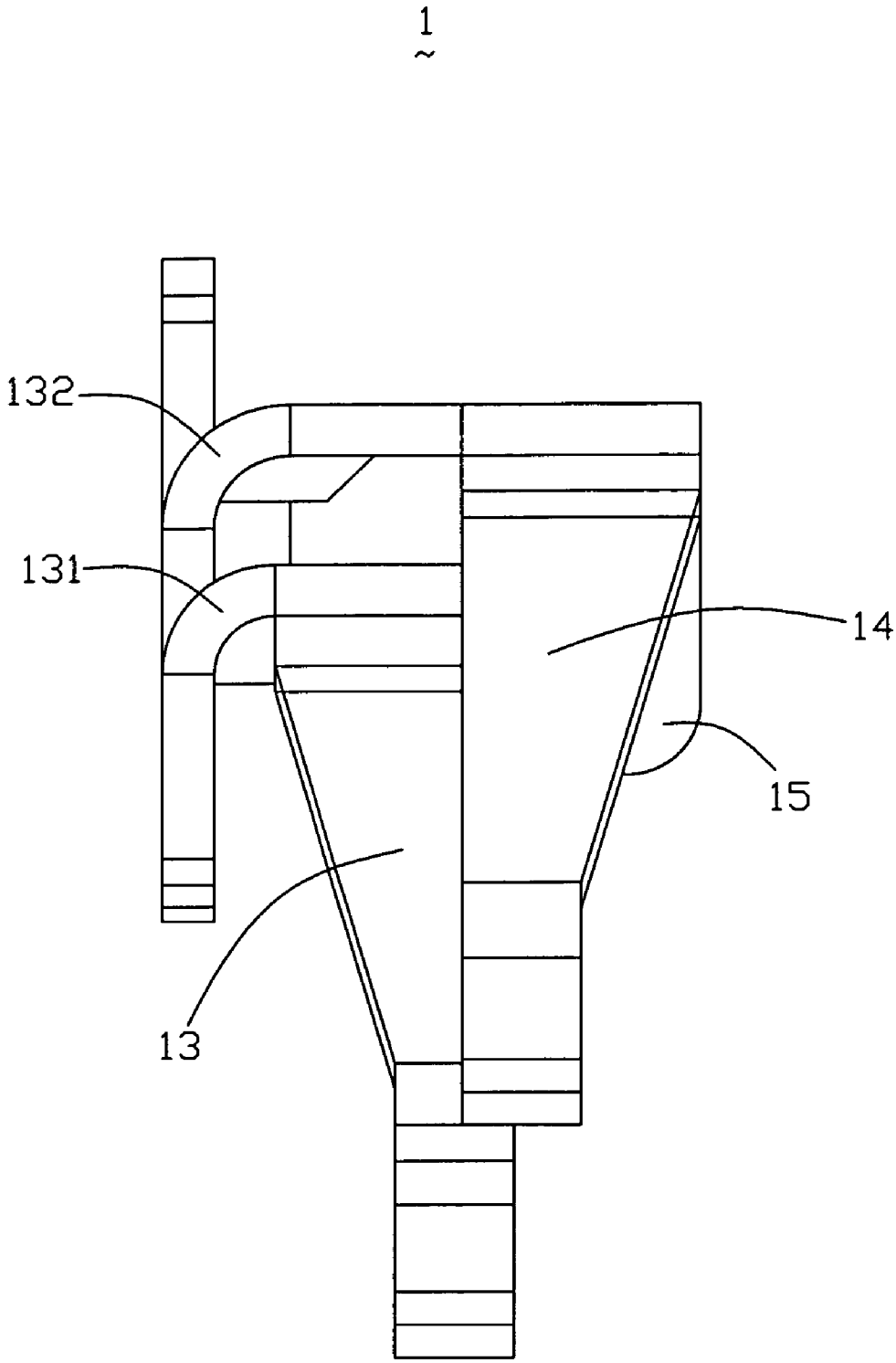
FIG. 3 illustrates a top view of the contact in FIG. 1.

Referring to FIG. 1 to 3 again, the first contact arm 13 extends from a first curved arm 131 to a first contact portion 130 having a first contact point thereof, and the second contact arm 14 extends from a second curved arm 141 to a second contact portion 140 having a second contact point thereof. The first contact arm 13 and the second contact arm 14 have a first contact base 132 and a second contact base 142, respectfully. The first contact base 132 and the second contact base 142 are substantially parallel to each other, but not aligned in the same plane. In addition, the projecting height from corresponding free ends of the first contact portion 130 and the second contact portion 140 to the solder portion 15 in a vertical direction are different as well. Furthermore, the bending angle between the first contact base 132 and the first contact portion 130 is not the same as that between the second contact base 142 and the second contact portion 140 as well. Furthermore, the distance from the first contact portion 130 to the engaging portion 12 is much closer to that from the second contact portion 140 to the the engaging portion 12 in a transverse direction. Due to increase of the space between adjoined contacts by foregoing arrangement of contact arms, not only the root purpose of lowing impedance of the LGA contacts is assured, but the undesired short caused by neighboring contacts is effectively prevented also.

Figure 4:
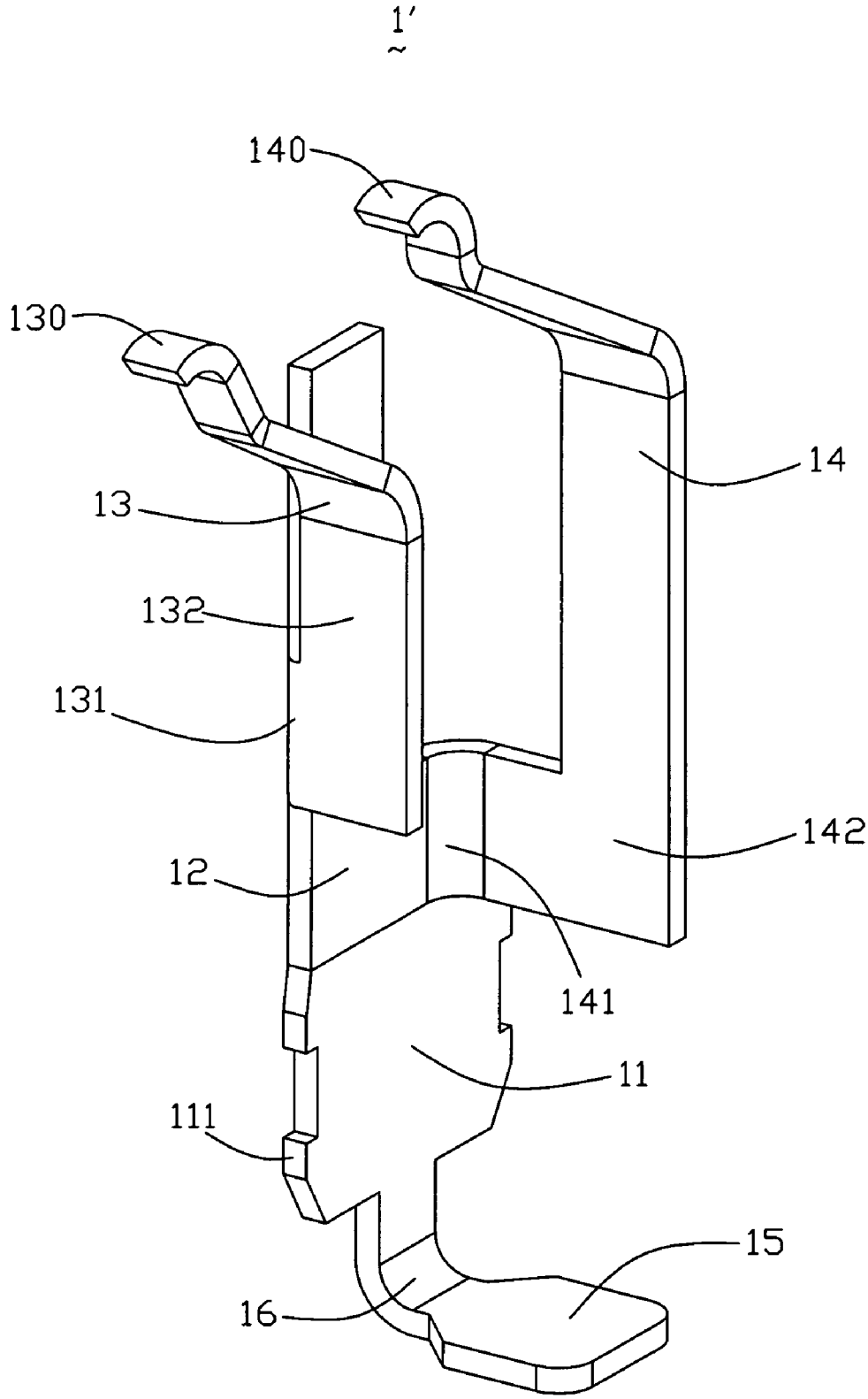
FIG. 4 illustrates an isometric view of a contact with dual arms in accordance with another embodiment of the present invention.
Figure 5:
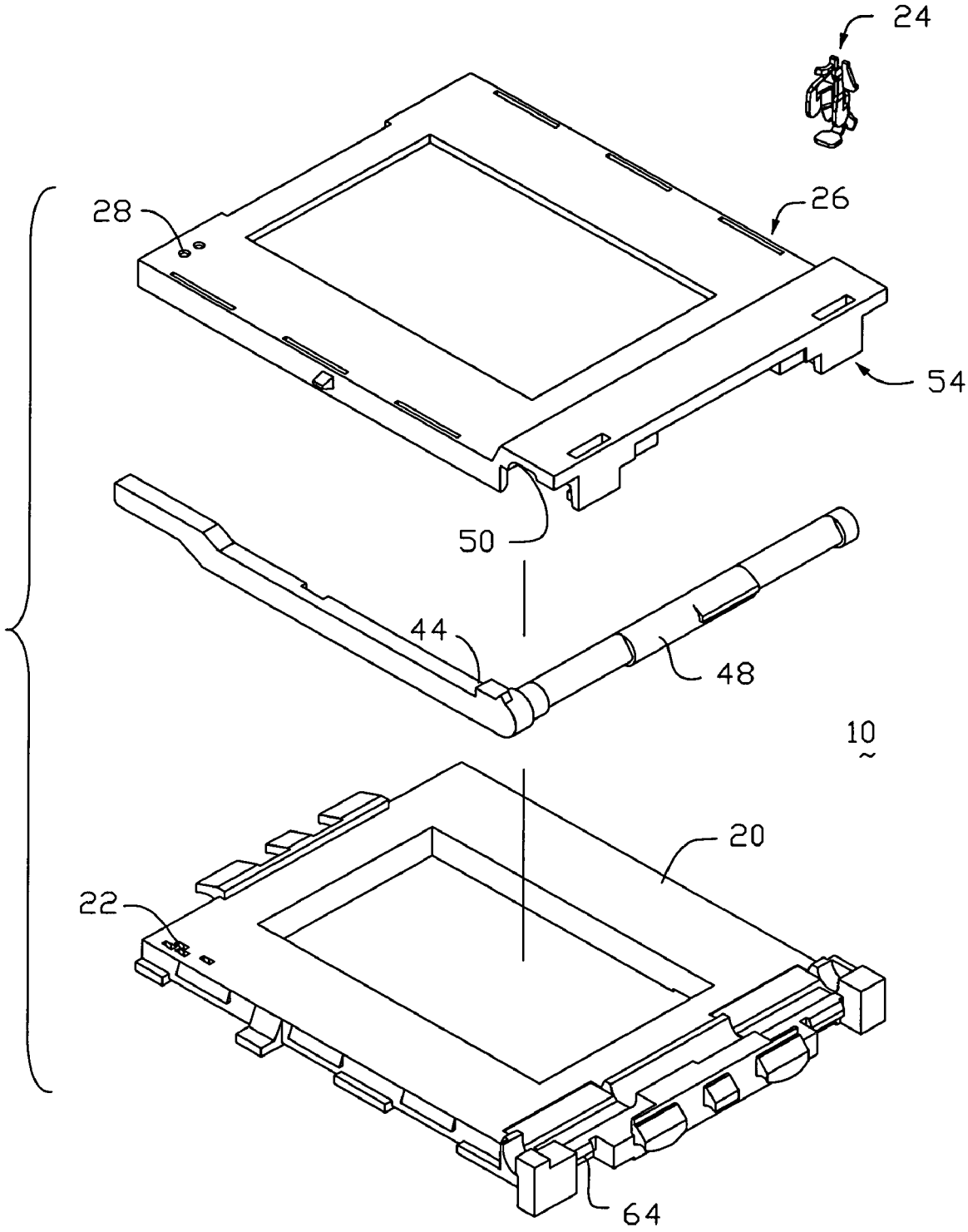
FIG. 5 (PRIOR ART)
FIG. 5 illustrates a decomposed view of a conventional ZIF PGA socket configured by respective components.
Figure 6:
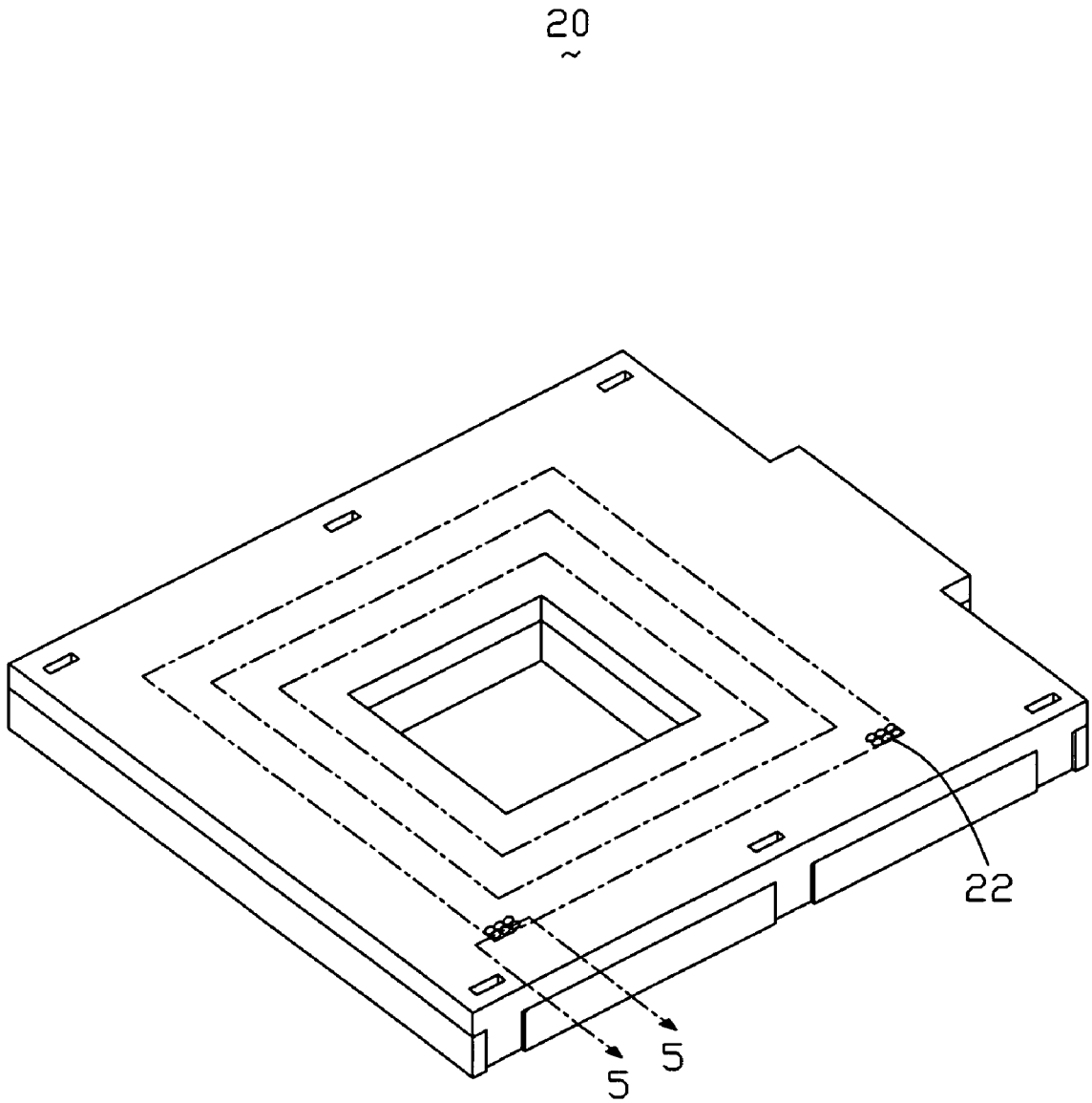
FIG. 6 (PRIOR ART)
FIG. 6 illustrates an insulative base of a conventional ZIF PGA socket.
Figure 7:
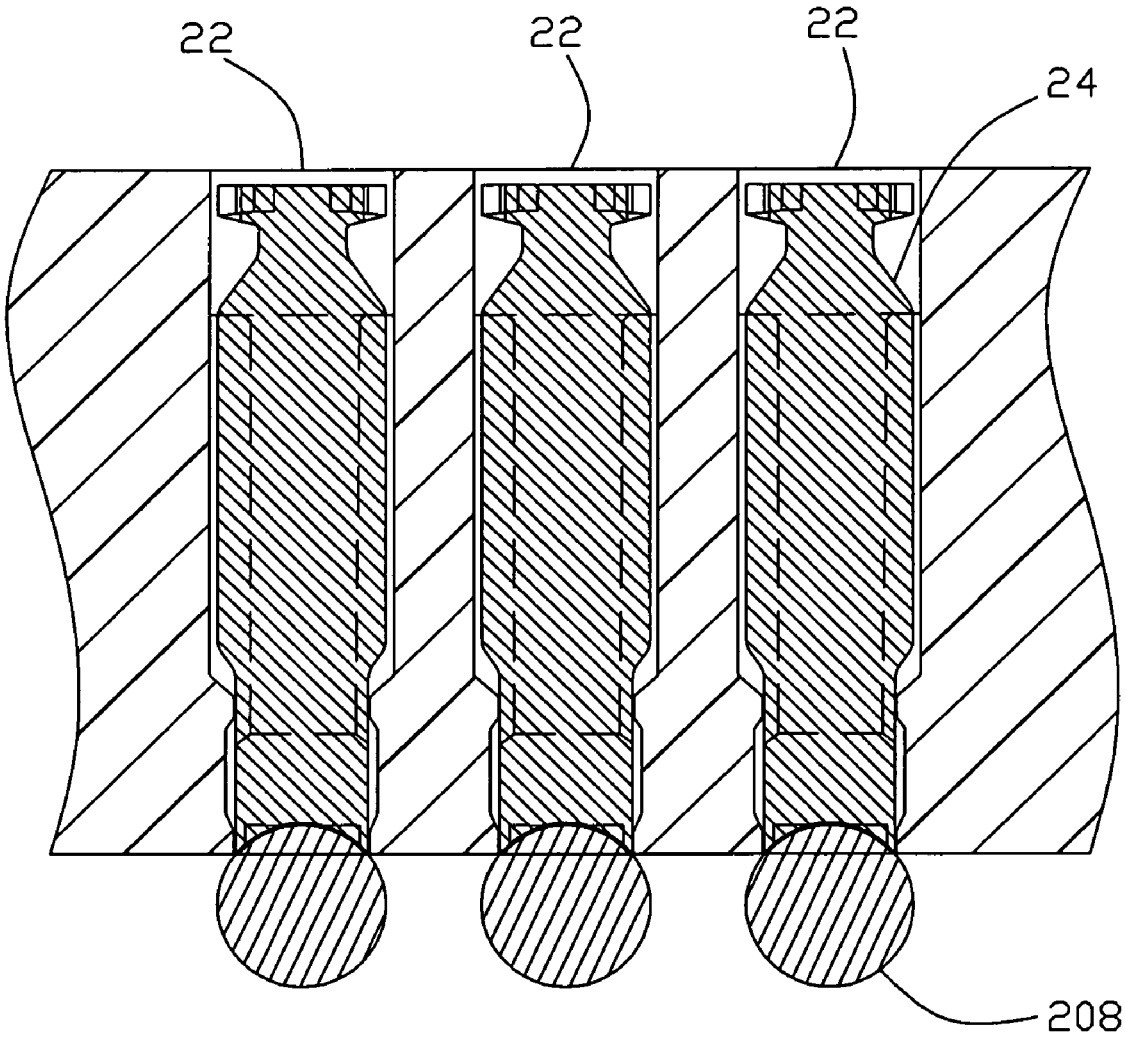
FIG. 7 (PRIOR ART)
FIG. 7 illustrates a cross-sectional view taken along lines 5-5 of FIG. 6.
Figure 8:
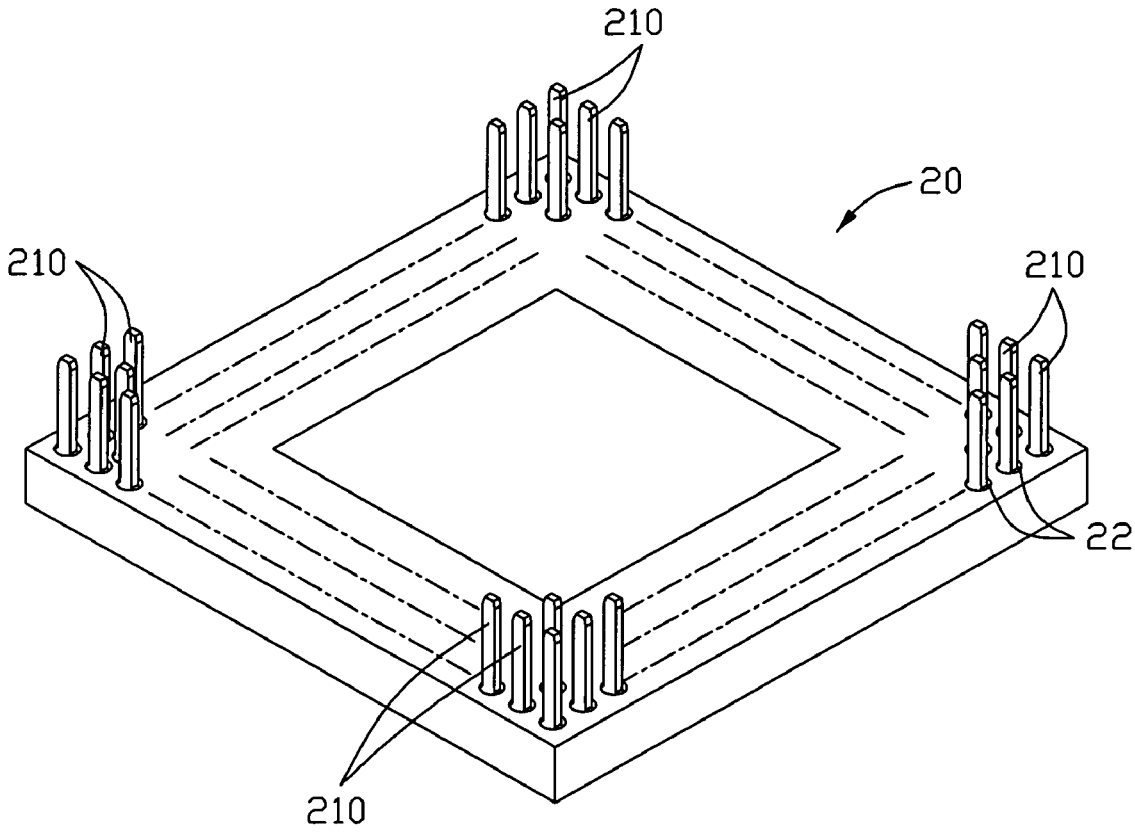
FIG. 8 (PRIOR ART)
FIG. 8 illustrates a pin grid array suitable for use with the ZIF PGA socket shown in FIG. 6.
Figure 9:
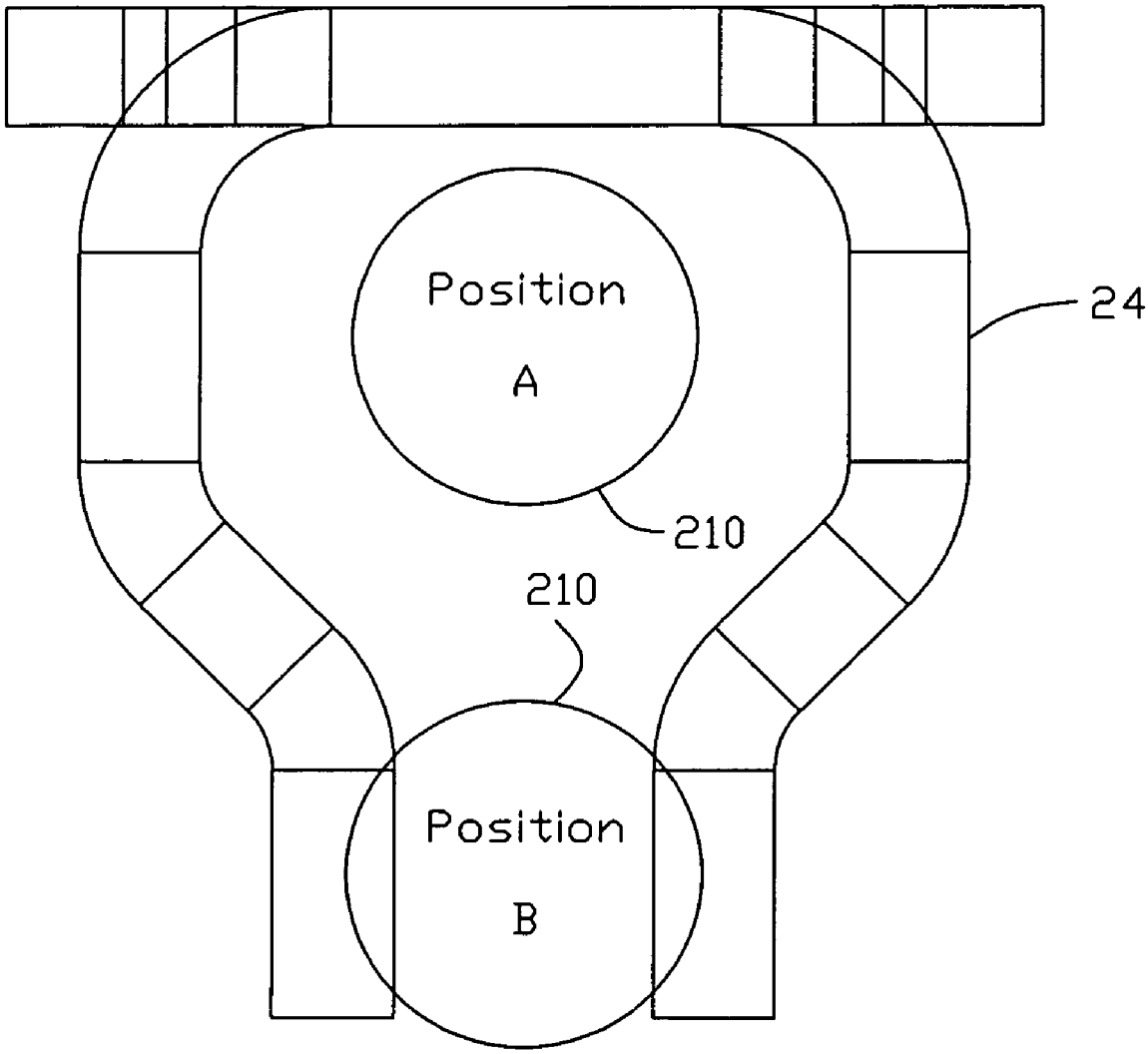
FIG. 9 (PRIOR ART)
FIG. 9 illustrates a top view of a pin inserted into a receiving portion of a contact restrained in a hole of the ZIF PGA socket shown in FIG. 6.
Figure 10:
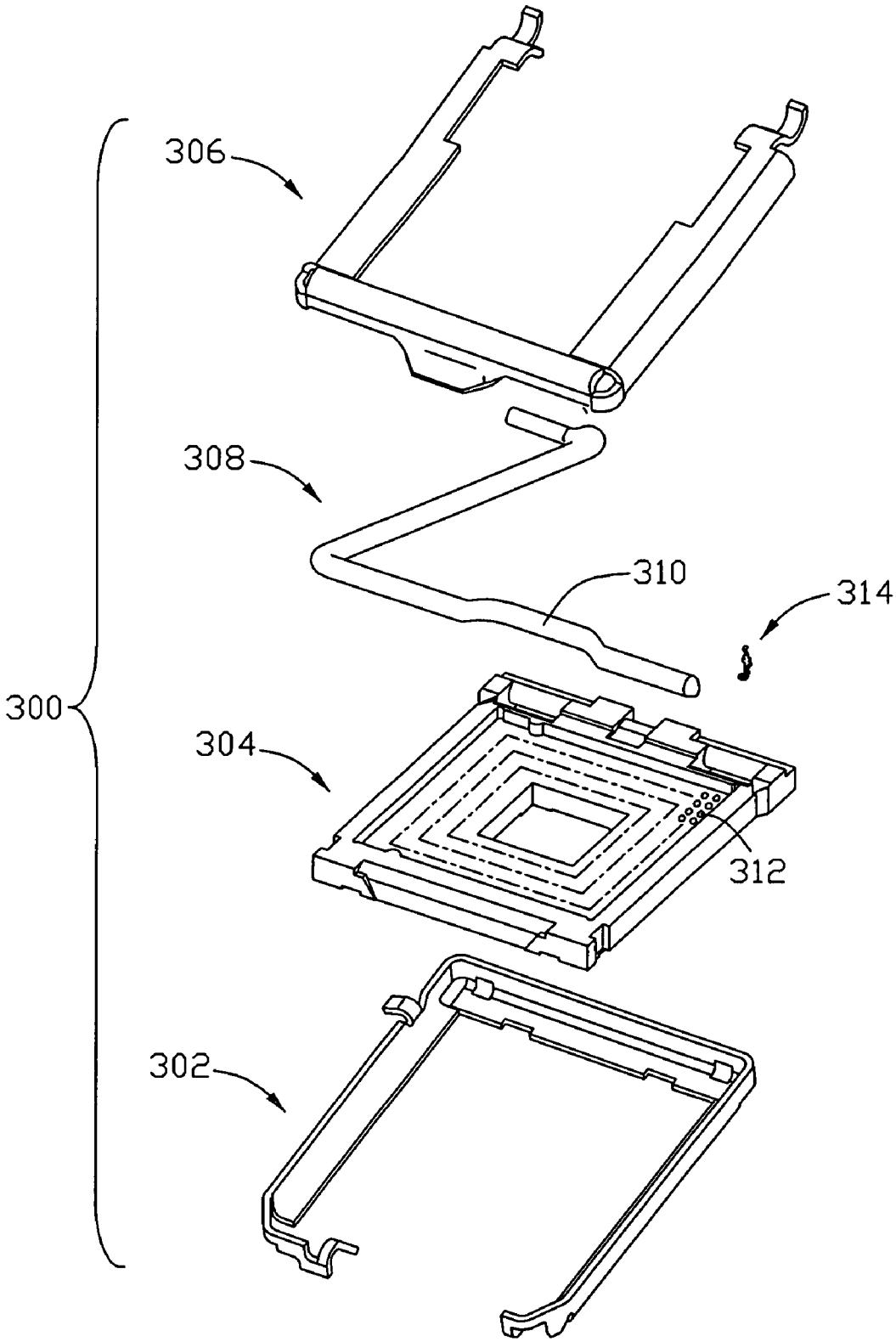
FIG. 10 (PRIOR ART)
FIG. 10 illustrates an decomposed view of a conventional LGA socket.
Figure 11:
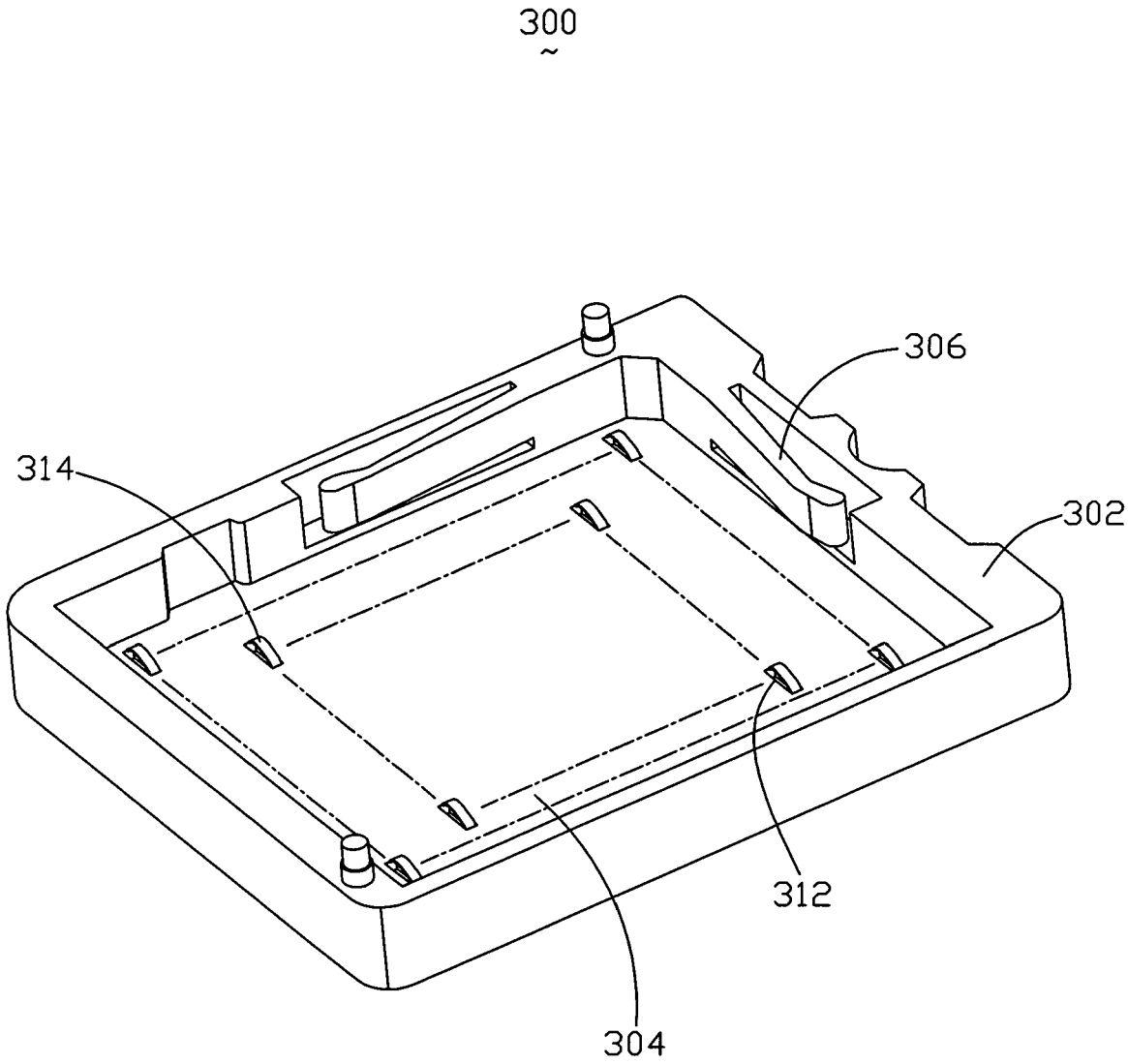
FIG. 11 (PRIOR ART)
FIG. 11 illustrates an isometric view of an insulative base holding contacts formed in a conventional LGA socket.
Figure 12:
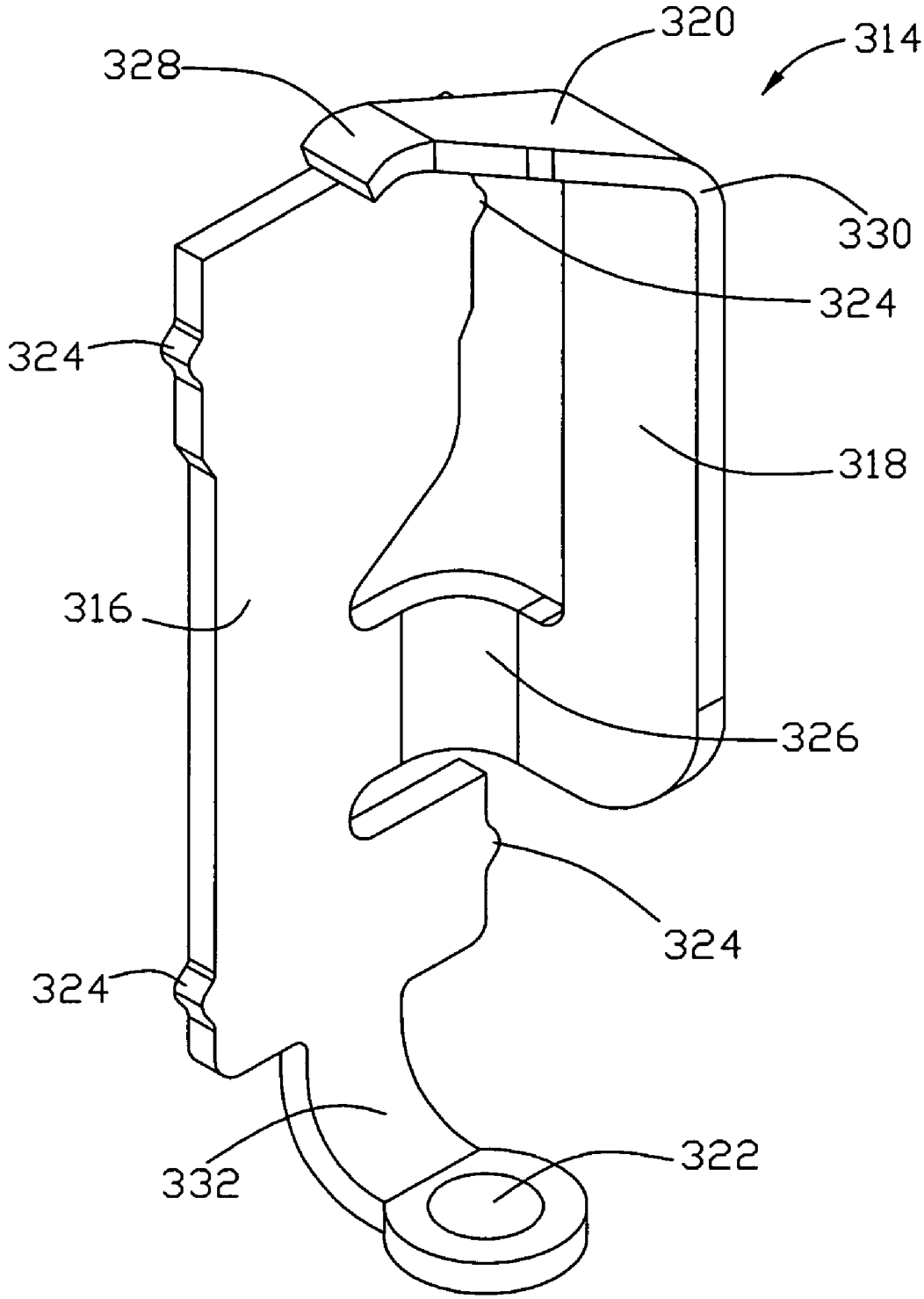
FIG. 12 (PRIOR ART)
FIG. 12 illustrates an isometric view of a contact formed in a conventional LGA socket shown in FIG. 10.
Figure 13:
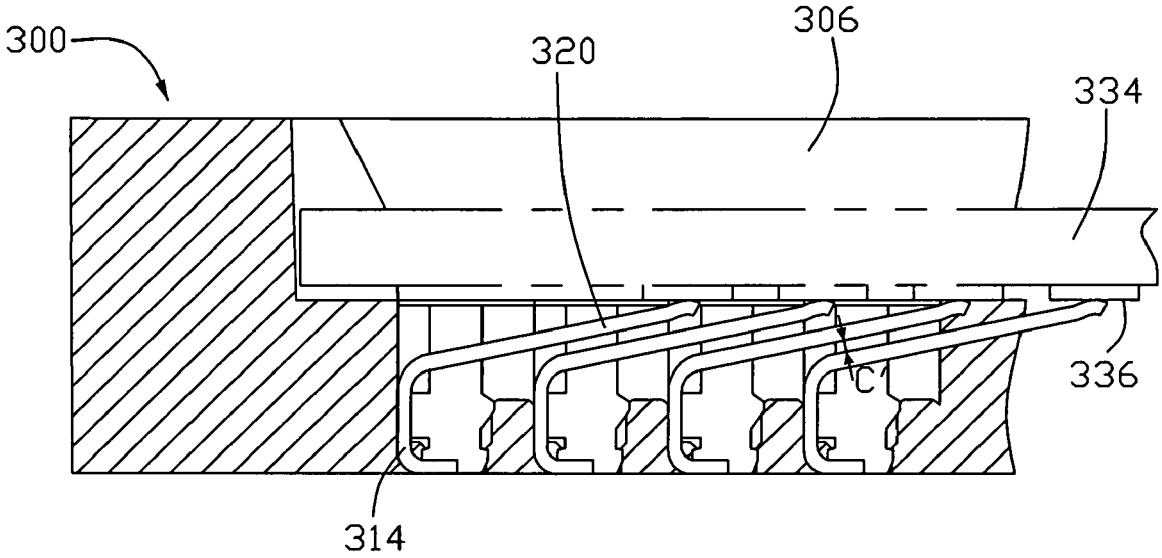
FIG. 13 (PRIOR ART)
FIG. 13 illustrates a side view of a conventional LGA socket; showing a contact in the conventional LGA socket warped by a pad of a CPU.

FIG. 4 shows an isometric view of a land grid array (LGA) contact terminal 1' formed in accordance with another embodiment of the present invention. The contact structure in FIG. 4 is similar to foregoing contact in FIG. 1. The main difference between FIG. 1 and FIG. 4 is that the first contact arm 13 or the second contact arm 14 respectively extend from opposite lengthwise side of the engagement 12. The man skilled in the art should understand that there is no restriction to limit either which lengthwise side should have a longer contact arm or the contact arms should be aligned in the same plane.

Therefore, according to the instant invention, an electrical connector for use with an electronic package, comprises an insulative housing defining an upper face for locating the electronic package thereabove; a plurality of contacts disposed in the housing, each of the contacts defining a retaining main body defining a center line C (FIG. 1), a first upwardly obliquely extending resilient arm with a first contacting end region extending above the upper face, and a second upwardly obliquely extending resilient arm with a second contacting end region extending above the upper face; both the first arm and the second arm extending toward a same direction in a top view, and the second arm being located beside the first arm in the direction and the first arm extending cross the center line; wherein the second arm is arranged to have the second contacting end region be relatively farther from the first arm of a neighboring contact for preventing shorting therebetween, which is located beside the contact in the direction, when both the two contacts are pressed downwardly by the electronic package, by means that either the first arm extends from the first position farther from the center line than a second position where the second arm extends, or the second end region experiences a less downward movement in a vertical direction and lateral movement in the direction than the first arm. It is also noted that both the position and the second position are located on a same side of the center line and the side is farther from the neighboring contact in the direction than the other side. It is also noted that before being downwardly pressed by the electronic package, the second end region is lower than the first end region so as to experience such less downward movement and lateral movement upon depression.

While a processor is put on an insulative housing of an electrical connector having a plurality passageways in which a plurality of contact terminals as described in FIG. 1 or FIG. 4, each pad of the CPU touches with the contact arms of the corresponding contact terminal. After that, a user may press down the processor by using a lever to press and fix a metal click pivotally attached to a stiffener such that a electrical connection is established between the processor and the electrical connector. Because there is enough space between adjacent contact arms of contact terminals with asymmetric contact arms configuration, the possibility of undesired short between adjacent contact arms is able to effectively reduce.

Although the present invention has been illustrated and described with respect to exemplary embodiment thereof, it should be understood by those skilled in the art that the various changes, omissions and additions may be made therein and thereto without departing from the spirit and scope of the present invention as set forth in the appended claims.

What is claimed is:

1. An electrical contact terminal, comprising:

a base portion having a retaining portion and an engaging portion extending upwardly from the base portion;

a first contact warping arm extending upwardly from a first portion of the engaging portion, and including a first contact point; and a second contact warping arm extending upwardly from a second portion of the engaging portion, and including a second contact point, the first contact point and the second contact point substantially having different projecting heights respectively measured from a solder portion of the contact terminal.

2. The electrical contact as claimed in claim 1, wherein the first contact arm and the second contact arm extend from a same lengthwise side of the engaging portion.

3. The electrical contact as claimed in claim 1, wherein the first contact arm and the second contact arm respectively extend from opposite lengthwise sides of the engaging portion.

4. The electrical contact as claimed in claim 1, wherein a length of the first contact arm is different from that of the second contact arm.

5. The electrical contact as claimed in claim 1, wherein the first contact arm and the second contact arm respectfully have a first contact base and a second contact base, the first contact base and the second contact base are substantially parallel to each other.

6. The electrical contact as claimed in claim 1, wherein the first contact portion to the engaging portion is closer than the second contact portion to the retaining portion in a transverse direction.

7. The electrical contact as claimed in claim 1, wherein an angle between the first contact base and the first contact portion is different from that between the second contact base and the second contact portion.

8. The electrical contact as claimed in claim 1, wherein both of the first contact base and the second contact base are respectively formed at an obtuse angle to the engaging portion.

9. The electrical contact as claimed in claim 1, wherein the retaining portion further comprises barbs thereon.

* * * * *